US006883288B1

(12) United States Patent
Harbin

(10) Patent No.: US 6,883,288 B1
(45) Date of Patent: Apr. 26, 2005

(54) J-CHANNEL

(76) Inventor: Todd Harbin, 90 Cattail Dr., Rock Spring, GA (US) 30739

( * ) Notice: Subject to any disclaimer, the term of this patent is extended or adjusted under 35 U.S.C. 154(b) by 0 days.

(21) Appl. No.: 10/668,407

(22) Filed: Sep. 23, 2003

Related U.S. Application Data

(60) Provisional application No. 60/413,212, filed on Sep. 24, 2002.

(51) Int. Cl.[7] ..... E04D 1/34

(52) U.S. Cl. ..... 52/521; 52/522; 52/539; 52/542; 52/545; 52/546; 52/551

(58) Field of Search ..... 52/521, 519, 520, 52/522, 539, 542, 545, 552, 747.1, 748.1

(56) References Cited

U.S. PATENT DOCUMENTS 3,757,483 A * 9/1973 Torbett ..... 52/522
4,854,101 A * 8/1989 Champagne ..... 52/520
5,339,608 A * 8/1994 Hollis et al. ..... 52/545
5,391,579 A 2/1995 Champagne ..... 52/520
5,537,791 A * 7/1996 Champagne ..... 52/520
5,581,970 A * 12/1996 O'Shea ..... 52/718.01
5,634,314 A * 6/1997 Champagne ..... 52/712
5,675,955 A * 10/1997 Champagne ..... 52/521
5,791,093 A * 8/1998 Diamond ..... 52/36.5
5,829,206 A * 11/1998 Bachman ..... 52/94
5,836,113 A * 11/1998 Bachman ..... 52/94
6,115,982 A * 9/2000 Lindenberg ..... 52/506.05
6,360,508 B1 * 3/2002 Pelfrey et al. ..... 52/520
6,625,941 B2 * 9/2003 Shaw ..... 52/211

* cited by examiner

*Primary Examiner*—Carl D. Friedman
*Assistant Examiner*—Yvonne M. Horton
(74) *Attorney, Agent, or Firm*—Stephen J. Stark; Miller & Martin PLLC

(57) ABSTRACT

A J-channel is provided with a retainer which biases an inserted siding panel against a cantilevered end of an outer face of the J-channel. The retainer has an engagement tab biased from a wall member which is preferably connected to an inner face of the J-channel member. An engagement tab and an inwardly directed lip at the cantilevered end of the outer face preferably retained an inserted panel therebetween.

16 Claims, 3 Drawing Sheets

J-CHANNEL

BACKGROUND OF THE INVENTION

This application claims the benefit of U.S. Provisional Patent Application No. 60/413,212 filed Sep. 24, 2002.

FIELD OF THE INVENTION

This invention relates to an accessory for use when installing panel siding on buildings and more particularly to an improved J-channel for use in receiving vinyl siding panel portions therein.

PRIOR ART

Vinyl siding has proven to be an economical and long lasting selection for exterior surfaces of buildings. More and more new homes presently utilize at least some vinyl siding on their exterior surfaces. Commercial buildings also are finding uses for vinyl siding. Furthermore, many older structures are often resurfaced with vinyl siding as an alternative to repainting.

When installing vinyl siding panels from top to bottom of the structure, normally a starting strip is placed along the bottom of the structure. A first panel is then locked into a lock in the starting strip and subsequent panels are locked into the next lower panel. The top portions of the panels are secured typically with nails in a nail hem which is located just above the lock utilized with the next higher panel to be connected thereto. The nail hem typically has a slot which allows side to side movement of the panel to allow for expansion and contraction.

Once the top of the structure is reached, installers typically locate an accessory known as a J-channel such as the one shown in FIG. 1 to receive the topmost panel. The illustrated prior art J-channel 10 has a shorter outer face 12 and a longer inner face 14 which are connected by bridge 16 to form a channel 18 therein, hence the name J-channel. Nail hems 20 are located along the inner face 14 so they are accessible by an installer to drive a nail therethrough to connect the J-channel 10 to a supporting structure such as a backing board or other appropriate location.

When the last panel 24 utilized before the J-channel 10 is to be installed, often it needs to be cut so that it fits within the J-channel 10. However, as can be seen in FIG. 2, the top end 21 of a cut channel, illustrated as leg 22, may not form a tight fit when inserted into the J-channel channel 10 such as when cut in the V-shaped groove as shown.

The upper face 12 of the J-channel 10 prevents an installer from being able to secure the leg 22 of the panel 24 to the backer board (not shown) or other structure. During heavy winds it is possible, especially if the last panel 24 were cut too short, that air can get through the channel 18 and into void 26 to thereby disconnect buttock 28 from lock 30 and then blow the top panel 24 off the building. This is somewhat unsightly.

In order to overcome this problem, installers have traditionally proceeded in one of two ways with furring strips which are a wooden or steel framing material typically rectangular in shape having one inch by three inch cross sections and used to provide an even nailing base. To "fur" a surface means to apply these strips.

FIGS. 3 and 4 show the two common prior art ways of utilizing furring strips 32. In FIG. 3, the furring strip 32 is installed to prevent panel detachment by preventing air from getting into channel 18 around the end 21 of panel 24 and into void 26. However, the furring strip 32 is not resilient and getting the top portion 22 intermediate the furring strip the top surface 34 of furring strip 32 can be challenging especially when trying to get the buttock (not shown in FIG. 3) to fit within the lock (not shown in FIG. 3) of the lower panel. Additionally, the installation of the furring strip 32 requires an additional step by the installer of installing the furring strip 32.

In FIG. 4, the panel 24 is cut on the flat surface 36 instead of along the V channel or leg 22 as shown in FIG. 3. In this installation the furring strip 32 is installed away from the upper face 12 of the J-channel 10. Under sill trim 38 is utilized to catch the panel 24 as shown. Not only does this step require the installation of furring strips 32, but also the necessary time and expense of installing under sill trim 38 as well. Snap lock lugs 40 are punched into flat surface 36 which cooperate with under sill trim 38 to prevent the panel 24 from pulling out of the under sill trim 38, but nothing secures the under sill trim 38 to the J-channel 10.

Many installers elect to cut corners and skip the step of installing furring strips 32. Additionally, the installation of furring strips 32, especially with the under sill trim 38, results in additional expense to the installer and thus, to the homeowner as well.

Several attempts have been made by at least one Texas individual to provide a better fit of siding panels in trim strips. U.S. Pat. Nos. 5,634,314 and 5,53,791 relate to clips which connect to a top piece of siding which are descried as being able to assist in retaining a siding panel in a trim strip. These clips appear to be attached to the siding at spaced apart locations. Furthermore, the siding panel may still need to be cut to rather close tolerances as shown in FIG. 4 of U.S. Pat. No. 5,634,314 so that the angled leg 14 of the clip contacts the inwardly turned edge 84 of the trim piece. If siding panel 20 is too short, the leg 14 would be located below the inwardly turned edge 84 and the clip would have absolutely no effect on retaining the siding in the trim piece. If the siding panel is too long, the leg 14 might be spaced from the edge 84 such that sufficient play could exist which could create various problems for the home owner.

Accordingly, a need exists to provide an improved J-channel which eliminates the need for the installation of furring strips and possibly under sill trim as well.

SUMMARY OF THE INVENTION

Accordingly, an object of the present invention is to provide an improved J-channel for use in installing vinyl siding panels.

Another object of the present invention is to provide a J-channel which captures and/or locks an inserted panel therein.

Another object of the present invention is to provide a retaining system for use with existing J-channel to capture inserted panels therein.

Accordingly, a J-channel having an outer face spaced from an inner face by a bridge to define a channel therein is also equipped with a retainer having an engagement tab which preferably contacts one of the outer face and a lip downwardly extending from the outer face at a curve. The engagement tab is spring biased against the outer face or lip by a resilient shoulder which is preferably connected to the inner face of the J-channel. It is preferred that the engagement tab and lip meet at a "V" so that an inserted panel is assisted in being driven between the two members. The inserted panel is preferably punched with snap lock lugs so that the snap lock lugs engage one of the lip and/or engagement tab when properly located intermediate the upper face and engagement tab.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
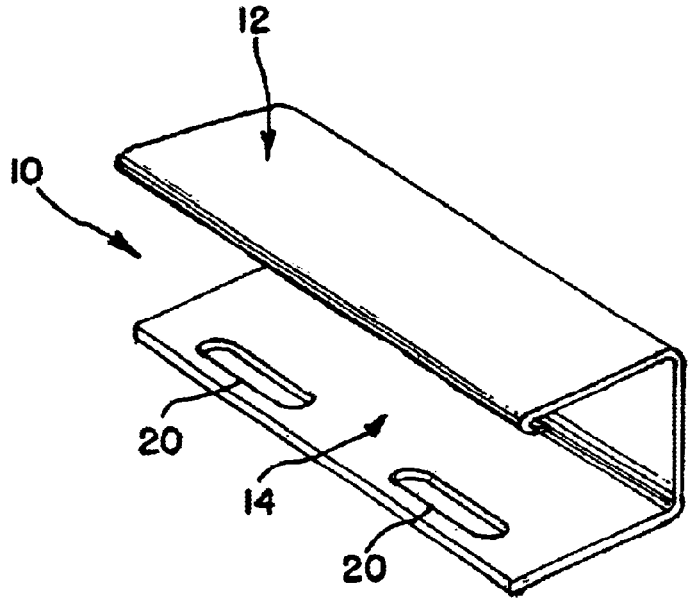
FIG. 1 PRIOR ART
FIG. 1 is a top elevational view of a prior art J-channel.
Figure 2:
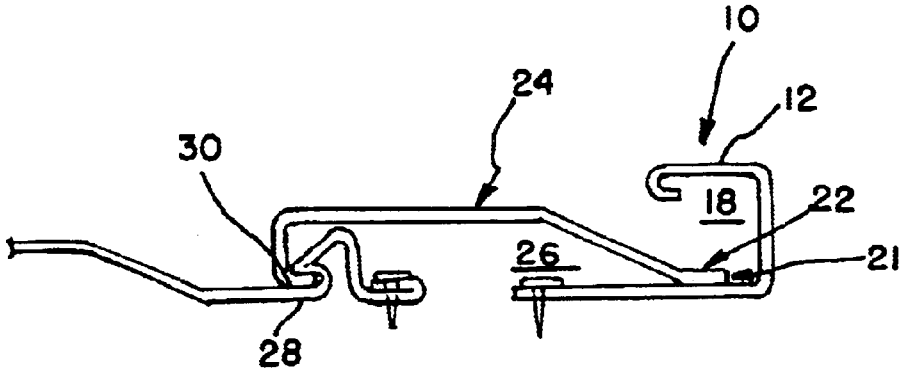
FIG. 2 PRIOR ART
FIG. 2 is a side cross-sectional view of a top panel locked to a lower panel with the top portion of the top panel located in a J-channel as is commonly performed in the prior art.
Figure 3:
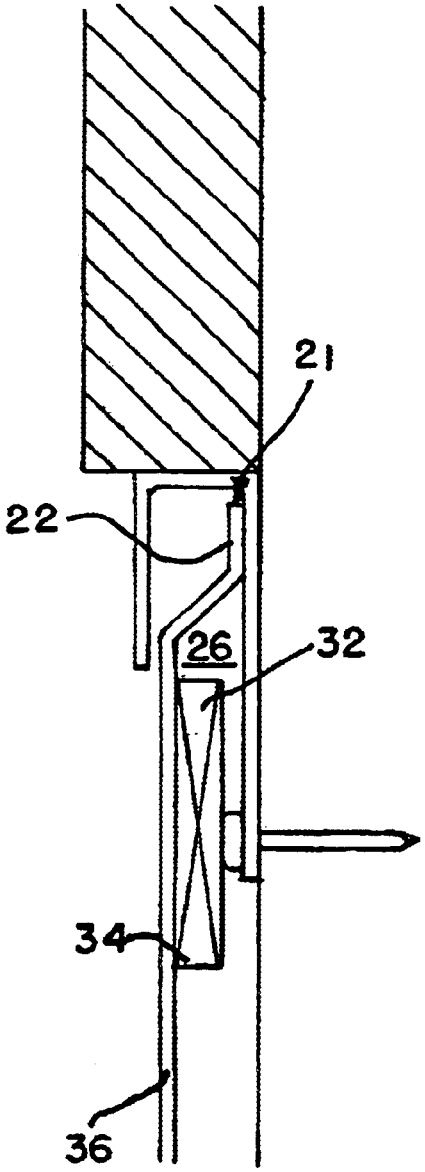
FIG. 3 PRIOR ART
FIG. 3 shows a top panel installed in a J-channel as has been done in the prior art.
Figure 4:
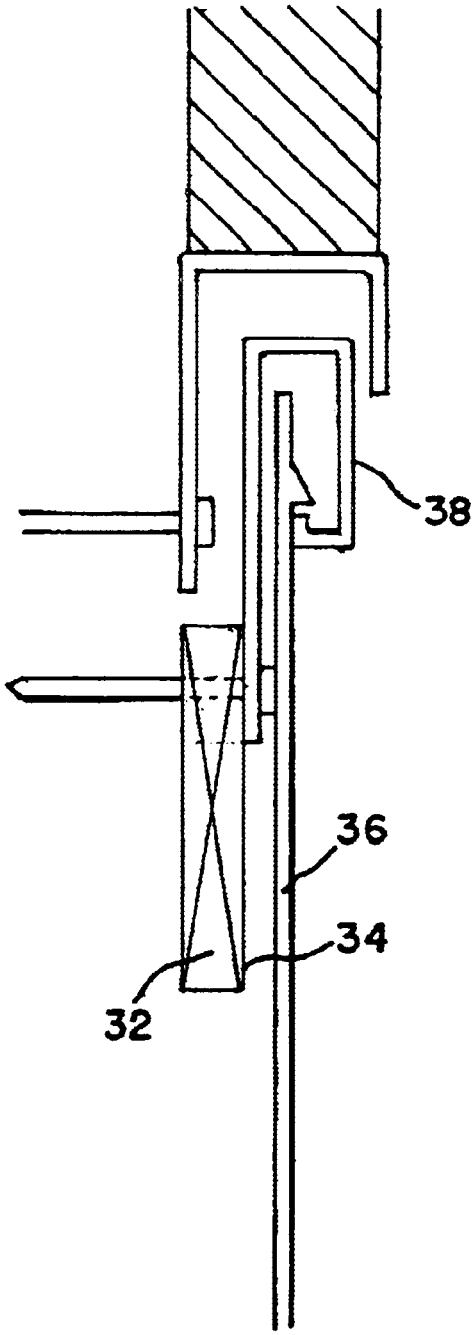
FIG. 4 PRIOR ART
FIG. 4 shows an alternative method of installing a top panel in a J-channel as is known in the prior art.
Figure 5:
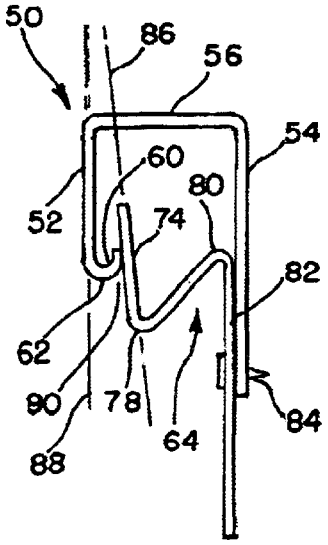
FIG. 5 shows a J-channel equipped with a retainer in accordance with an alternatively preferred embodiment of the present invention.
Figure 6:
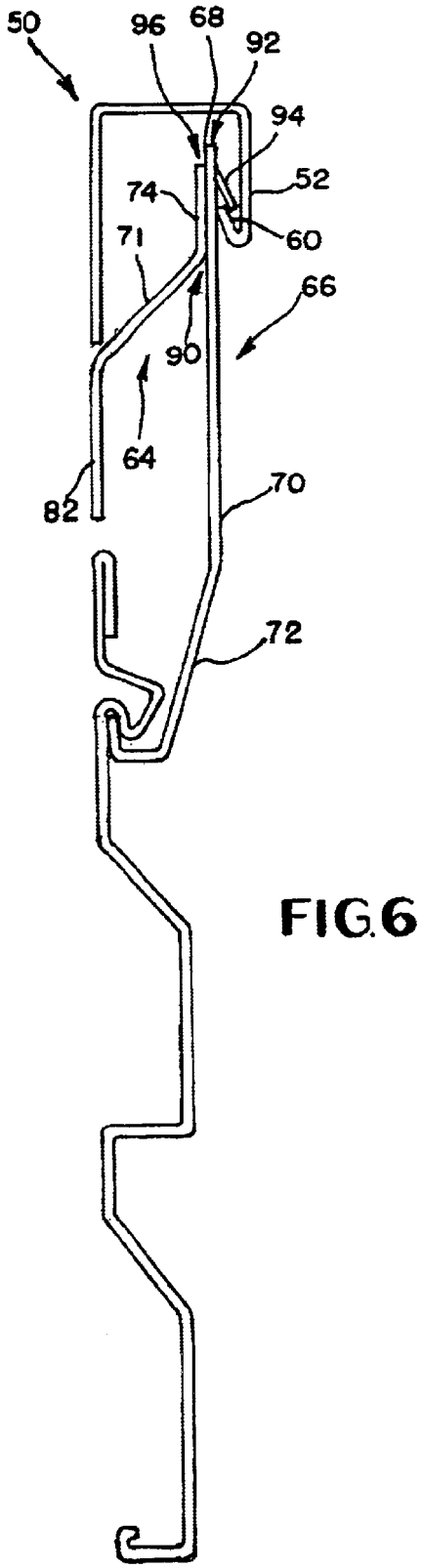
FIG. 6 shows an installed upper panel connected to a lower panel as well as to the J-channel utilizing a preferred embodiment of the J-channel of the present invention.

FIGS. 5 and 6 show the improved J-channel 50 of the present invention for use with siding products such as vinyl, aluminum, or other panel siding product. Of the improved J-channel 50 has outer face 52 spaced from inner face 54 by bridge 56 to create channel 58 therein. The upper face 52 preferably has a lip 60 connected to the upper face 52 by curve 62. This lip 60 is illustrated oriented toward the bridge 56 in this embodiment. Other designs may or may not utilize alternatively constructed lips 60. The J-channel 50 also includes a retainer 64 which is utilized to capture an uppermost panel 66 relative to the lip 60 and/or outer face 52 of the J-channel 50. Although leg 68 is shown captured by the retainer 64 relative to the outer face 52 in FIG. 6, the V-slant 70, the top face 72 of panel 66, or other appropriate panel portion could also be captured in a similar manner.

The retainer 64 illustrated in FIG. 5 is an alternatively preferred embodiment and includes an engagement tab 74 which is biased toward and preferably against one of the outer face 52 and/or the lip 60 of the J-channel 50. The biasing is accomplished through the utilization of shoulder 76 connected by curve 78,80 to wall member 82. The shoulder when combined with the curve 78,80 provides resiliency to the engagement tab 74 so that the engagement tab 74 is preferably displaceable towards the inner face 54 so that a panel 66 may be slid intermediately engagement tab 74 and the outer face 52 of the J-channel 50. Additionally, the outer face 52 may be somewhat resilient relative to the engagement tab 74 so that the outer face 52 and/or lip 60 is resiliently disposed relative to the engagement tab 74. The retainer 64 can be formed where the engagement tab 74 would otherwise be above the outer face 52, however, after formation, the tab 74 placed below the outer face 52.

The wall member 82 may or may not be a portion of the inner face 54. Furthermore, the nails 84 which secures the J-channel 50 to a backing board (not shown) may also be utilized to secure the wall member 82 to one of the backing board (not shown) and/or the inner face 54 of the J-channel 50. In some embodiments, the inner wall 80 may be integrally connected to the inner face 54.

The shoulder 76 preferably a spanning member which is utilized along the curves 78,80 to bring to the engagement tab 74 against the lip 60 and/or outer face 52. The engagement tab 74 and at least a portion of the wall member 82 may be substantially parallel as illustrated. The shoulder 76 may be substantially perpendicular to one of the engagement tab 74 or wall member 82 or downwardly angled from the wall member 82 and acutely angled relative to both the wall member 82 and engagement tab 74 as illustrated. Alternatively, the shoulder 76 may be upwardly angled relative to the engagement tab 74 so that it is obtusely angled relative to the engagement tab 74 or the outer face 52 of the J-channel 50. In some embodiments the shoulder 76 and engagement tab 74 may be integrally connected and difficult to distinguish where one begins and the other ends.

The outer face 52 of the J-channel is normally parallel to the inner face 54 which provides a pleasing aesthetic appearance. The engagement tab 74 is preferably located along the engagement tabs plane 86 which is angled relative to face plane 88 which contains the outer face 52. As illustrated, the angle between the face plane 88 and the engagement tab plane 86 is acutely angled and preferably less than about 45°, more preferably less than about 30°, less than about 10° or about 5° as illustrated.

When the curve 62 connects with lip 60 as illustrated in FIG. 5, the lip 60 and/or curve 62 and the engagement tab 74 form a "V" 90 which is believed to assist in placing the panel 66 as shown in FIG. 6 so that the plank 66 is captured intermediate the engagement tab 74 in the lip 60. Since at least one of the engagement tabs 74, the lip 60, and/or outer face 52 is resilient, the appropriate member 52,60,74 is displaced with the insertion of the plank 66 as shown in FIG. 6. The panel end 92 may be pushed against the "V" 90 to install the panel 66 in the J-channel 50. In the preferred embodiment, the engagement tab 74 is inwardly displaced during the installation of the panel 66 as shown in FIG. 6. The shoulder 76 and curves 78,80 provide a spring to resiliently bias the engagement tab 74 against the panel 66 and the panel 66 against at least one of the lip 60 and outer face 52.

In FIG. 6, the presently preferred embodiment is shown with shoulder 77 upwardly angled relative to wall member 82. This assists in forming V 90 for installing the panel 66. Angle illustrated is about 45° over angle such as 30 to 60' could also be utilized for the shoulder 77.

Figure 7:
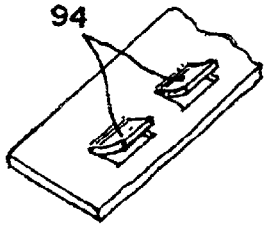
FIG. 7 PRIOR ART
FIG. 7 shows snap lock lugs punched into a panel using a snap lock punch as is known in the prior art.

The upper portion 92 of panel 66 is preferably punched with snap lock lugs 94 as illustrated in FIG. 7 as is known in the art. The lugs may be outwardly oriented as shown in FIG. 6 so that they cooperate with the lip 60 to prevent the panel 66 from being downwardly pulled from the J-channel 50. Alternatively, if no lip is present on the J-channel embodiment, the lugs 94 may be inwardly oriented towards the engagement tab 74 so that they overlap end 96 of the engagement tab 74. The end 96 of the engagement tab 74 preferably terminates at a predetermined distance away from bridge 56.

While the retainer 64 of the preferred embodiment is somewhat "S" or "Z" shaped, other configurations may also be utilized to provide at least some resiliency to the engagement tab 74 to locate and bias the tab 74 towards the outer face 52 of J-channel 50.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

What is claimed is:

1. A J-channel connection for use with an inserted siding panel comprising:

a J-channel member having an inner face, a bridge, and an outer face, said bridge connecting the inner face to the outer face, said inner face and said outer face being substantially parallel to one another and spaced apart by a channel, said outer face having a cantilevered end spaced from the bridge;

a retainer having a wall member resiliently connected to an engagement tab terminating at an end, said wall member fixedly secured relative to the inner face of the J-channel member, said engagement tab biased toward the cantilevered end of the outer face of the J-channel member;

a siding panel having an inserted end, whereby the engagement tab and the cantilevered end of outer face cooperate to capture the end of the inserted siding panel intermediate the engagement tab and the outer face in an inserted configuration with the siding panel separating the end of the engagement tab from the outer face in the inserted configuration.

2. The J-channel connection of claim 1 wherein the cantilevered end of the outer face has an inwardly directed lip, and the lip and the engagement tab cooperate to capture the inserted siding panel therebetween and the end of the engagement tab is separated from the lip by the inserted siding panel.

3. A channel connection for use with an inserted siding panel comprising:

a channel member having an inner face, a bridge, and an outer face, said bridge connecting the inner face to the outer face, said inner face and said outer face being spaced apart by a channel, said outer face having a cantilevered end spaced from the bridge and an inwardly directed lip, extending from the cantilevered end;

a retainer having a wall member resiliently connected to an engagement tab, said wall member fixedly secured relative to the inner face of the channel member, said engagement tab biased against the cantilevered end of the outer face of the channel member in a pre-panel insertion configuration; and a siding panel having lugs directed toward the outer face of the channel member and an inserted end captured intermediate the engagement tab and the inwardly directed lip extending from the cantilevered end of the outer face in an inserted configuration.

4. The channel connection of claim 3 wherein the cantilevered end of the channel member further comprises an inwardly directed lip, said inwardly directed lip contacting the engagement tab in the pre-panel insertion configuration.

5. The channel connection of claim 3 wherein the inner face and the outer face of the channel member are substantially parallel.

6. The channel connection of claim 3 wherein the bridge is perpendicular to the outer face.

7. The channel connection of claim 3 wherein the bridge is perpendicular to the inner face.

8. The channel connection of claim 3 wherein the inner face of the channel member has a length greater than a length of the outer face.

9. The channel connection of claim 3 wherein the wall member of the retainer is fixedly secured to the inner face of the channel member.

10. The channel connection of claim 3 wherein the wall member is parallel to the inner face of the channel member.

11. The channel connection of claim 3 wherein the engagement tab and the wall member are substantially parallel.

12. The channel connection of claim 11 further comprising a shoulder connecting the engagement tab and wall member.

13. A J-channel connection in combination with an inserted siding panel comprising:

a J-channel member having an inner face, a bridge, and an outer face, said bridge connecting the inner face to the outer face, said inner face and said outer face being substantially parallel to one another and spaced apart by a channel, said outer face having a cantilevered end spaced from the bridge and an inwardly direct lip extending therefrom; and a retainer having a wall member resiliently connected to an engagement tab, said wall member fixedly secured to the inner face of the J-channel member, said engagement tab biased toward the cantilevered end of the outer face of the J-channel member; and a siding panel having lugs, said siding panel inserted intermediate the engagement tab and the cantilevered end of the J-channel member into the channel into an installed configuration with said lugs contacting one of the retainer and the inwardly directed lip.

14. The combination of claim 13 wherein the siding panel is inserted along an insertion plane and the insertion plane is intersected only by the siding panel in the channel.

15. The combination of claim 13 wherein the J-channel member has a width and the retainer has a width and the widths of the J-channel member and the retainer are substantially equal.

16. The J-channel of claim 13, wherein the siding panel is movable relative to the retainer in the installed configuration.

* * * * *